United States Patent [19]

Slettedal

[11] Patent Number: 4,822,230

[45] Date of Patent: Apr. 18, 1989

[54] PIPE HANDLING APPARATUS

[75] Inventor: Per Slettedal, Øvrebø, Norway

[73] Assignee: Maritime Hydraulics A.S., Kristiansand, Norway

[21] Appl. No.: 110,432

[22] Filed: Oct. 20, 1987

[30] Foreign Application Priority Data

Oct. 22, 1986 [NO] Norway ..... 864219

[51] Int. Cl.[4] ..... E21B 19/14

[52] U.S. Cl. ..... 414/22.54; 175/85; 414/746.8

[58] Field of Search ..... 175/52, 85; 414/22, 414/745

[56] References Cited

U.S. PATENT DOCUMENTS 2,956,782 10/1960 Mistrot ..... 175/85 X 3,404,741 10/1968 Gheorghe et al. ..... 175/85

3,633,771 1/1972 Woolslayer et al. ..... 414/745 X

*Primary Examiner*—Robert J. Spar

*Assistant Examiner*—Janice Krizek

*Attorney, Agent, or Firm*—Cushman, Darby & Cushman

[57] ABSTRACT

A pipe handling apparatus is disclosed, which is adapted for automated drilling operations. Drill pipes are manipulated between substantially horizontal and vertical positions, and the apparatus is used with a top mounted drilling device which is rotatable about a substantially horizontal axis. The apparatus comprises a strongback provided with clamps to hold and manipulate pipes. The strongback is at one end portion rotatably connected to the same axis as the drilling device. The strongback moves up or down with the drilling device. A brace unit is attached to the strongback to be rotatable about a second axis spaced apart from said first axis. The brace unit has one end portion rotatable about a third axis.

6 Claims, 7 Drawing Sheets

20
28
22
4
6
10
27
5
6
25

PIPE HANDLING APPARATUS

BACKGROUND OF THE INVENTION

The present invention relates to a pipe handling apparatus adapted to automatic drilling operations, in which drill pipes are manipulated between substantially horizontal initial or final positions, and approximately vertical drill centre positions, for use with a top mounted drilling device which is rotatable about a substantially horizontal first axis.

Automatic systems for drilling operations are previously known which furthermore are able to carry out tripping operations, e.g. when a drill bit is to be replaced or logging or service operations are to be carried out. It is known that to pull out a drill string from oil or gas wells in the conventional way are very time consuming operations. Tripping operations are especially time consuming in case of drilling at greater depths requiring more frequent replacements of drill bits. The total drilling time in case of deep wells is, thus, considerably increased and results in increased costs.

U.S. Pat. No. 3,404,741 discloses an automated system for drilling and pipe manipulation. Drill pipes are placed in a horizontal position halfway up in the derrick before the pipes are manipulated into a vertical position. The structure comprises a drilling device which is rotatable about a horizontal axis. In its horizontal or lying position the pipe may be inserted into the drilling device which is subsequently raised permitting the pipe to be moved into a vertical position. At its other end the pipe is guided by a carriage moving on rails. During the raising operation the pipes are only supported at their end portions and, obviously, only short pipe lengths can be raised in this way. In order to reduce the time consumption it is, however, common and desirable today to manipulate pipe sections or stands comprising two or three assembled single pipes, i.e. sections that may be up to 30 m long.

U.S. Pat. No. 3,986,619 also describes equipment for manipulating pipes in order to move drill pipes from a horizontal into a vertical position. Entire pipe stands are manipulated by this system. The equipment comprises a mechanism elevating the stands in a horizontal position from the drill floor up to a predetermined level. The equipment for manipulating pipes comprises a series of blocks, pulleys and wires and is, apparently not adapted for automated operation.

SUMMARY OF THE INVENTION

With the equipment according to the invention the pipe handling operation may be automated thus avoiding time consuming and hazardous manual labour. Thus, time consumption, and consequently the total drilling costs may be reduced simultaneously as the work environmental conditions are considerably improved.

This is achieved by a pipe handling apparatus which is characterized by a strongback comprising means for holding and manipulating pipes, said strongback being connected at one end portion independently rotatable about said first axis for movement up or down with the drilling device, a brace unit rotatably connected to said strongback about a second axis spaced apart from said first axis, mounting means about which the end portion of said brace unit is rotatable about a third axis, said axis being arranged in such positions relative to each other that a drill pipe is moved from said horizontal position to the drilling centre in said substantially vertical position, or vice versa.

The means for holding pipes may comprise several spaced apart arms including pipe gripping means or clamps and means for operating said clamps to grip around the pipe. The means for holding and manipulating pipes may comprise means for synchronizing operation of the arms for inserting or retracting drill pipes relative to the drilling device. Said arms may be arranged to be slidable along the strongback, and they may be articulated and provided with arresting means preventing the arms from turning towards the drilling means more than into an approximately orthogonal position relative to the strongback when the arms are manipulated. The space between the first and second axes, and the space between the second and third axes is, suitably, adjustable, e.g. by means of a rack/pinion which is driven by a motor or the like.

Preferably, the third axis is restricted movably in a substantially vertical way in a slot or a coulisse guide, in order to provide a safety margin for the drilling device and the pipe handling apparatus when the drilling device approaches its upper position.

In order to ensure that the pipe stand may readily be removed from the drilling centre, the space between the longitudinal axis of the strongback and the longitudinal axis of the pipe stand in a manipulating position is advantageously longer than the horizontal space between the third axis and the drilling centre, so that a knuckling point is formed in the second axis.

Other and further objects, features, and advantages of the invention will appear from the following disclosure of an embodiment which is preferred at present and is meant for illustration together with the accompanied drawings.

DETAILED DESCRIPTION

Figure 1:
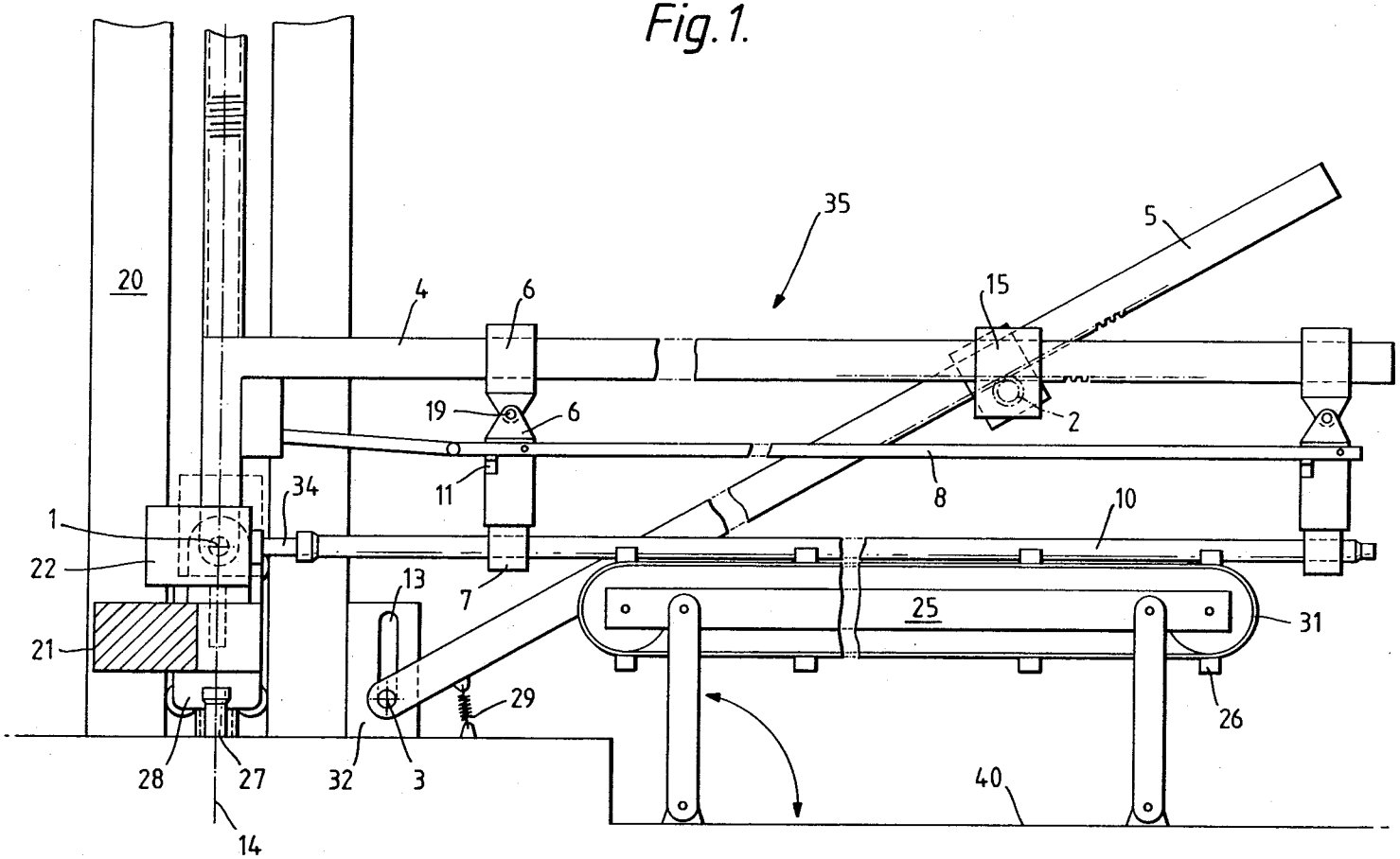
FIG. 1 is a diagrammatic representation of the pipe handling apparatus according to the invention in a vertical section and in a folded or horizontal position together with a drilling device in a derrick.

An embodiment of the invention is shown in the drawings, in which FIG. 1 illustrates the pipe handling apparatus 35, a derrick 20, and a raising/lowering table 25. The drilling device 22 is of the top mounted type, i.e. the drilling device 22 driving the drill string 27 advances with the drill string 27 as the drill bit progresses downwardly in the borehole. The derrick 20 with associated drilling device 22 may be of the conventional kind with draw works hoisting means comprising a crown block, a travelling block and wireline arrangements. Other concepts for raising and lowering the drilling means, e.g. hydraulic cylinders, racks and screws may be adapted to the present system for manipulating pipes. A guide carriage 28 with a cross beam 21 guides and supports the drilling device 22 in derrick 20. Drilling device 22 is rotatable about a first axis 1 for approximately 90° permitting the drilling device 22 to occupy a substantially horizontal position.

The raising/lowering table 25 supplies lying pipes 10 from a drill pipe storage or drill floor 40 up to a predetermined level. Table 25 comprises an endless belt 31 with cradles 26 of a rubber material or the like mounted on belt 31; said cradles 26 have recessed grooves for the pipe stands. The endless belt 31 may be driven either direction in order to roughly position pipe 10 in its horizontal position, by means of a motor (not shown). A motor, levers or hydraulic cylinders (not shown) move table 25 from drill floor 40 to a raised position.

Figure 8:
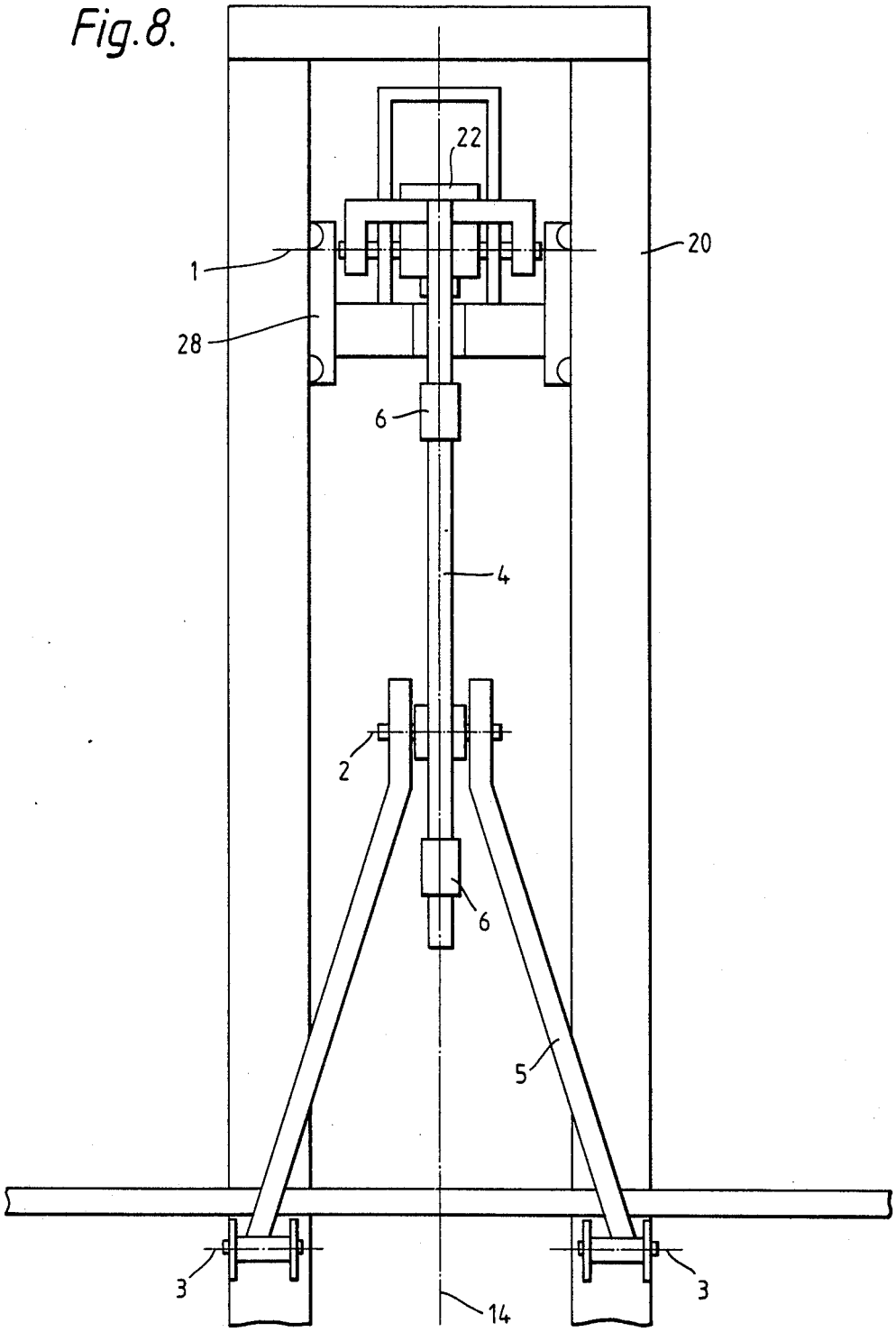
FIG. 8 is a diagrammatic front view of the pipe handling apparatus, as seen towards the derrick.
Figure 9:
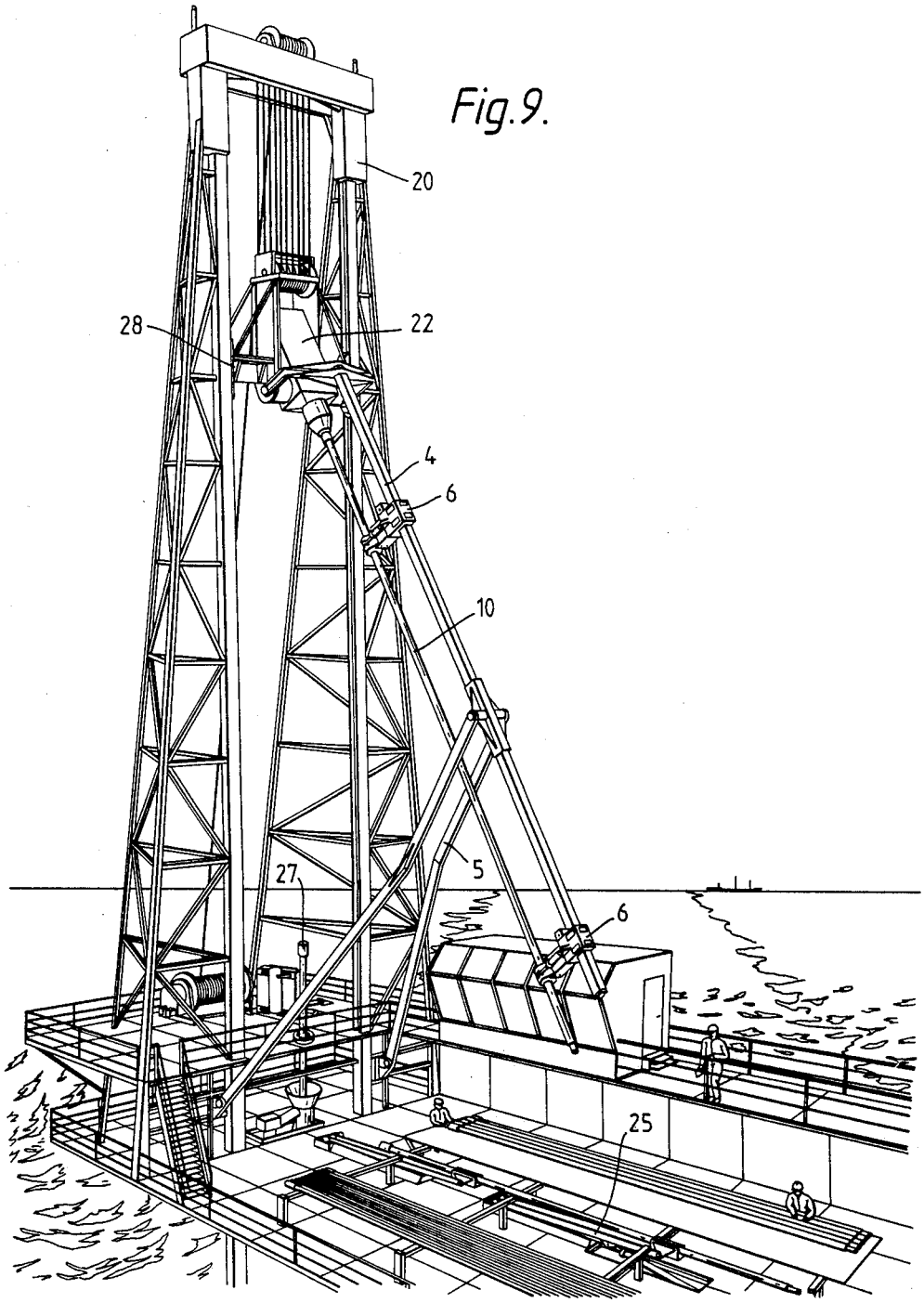
FIG. 9 is a perspective view of the pipe handling apparatus according to the invention.

The pipe handling apparatus 35 comprises a strongback 4 which is rotatably attached to the drilling device 22. The drilling device 22 and strongback 4 are independently rotatable about the same first axis 1. Two or more arms 6 are slidably arranged on the strongback 4, which arms are provided with clamps 7 to grip a drill pipe 10 or a drill pipe stand. The clamps 7 comprise the means (not shown) for actuating said clamps to embrace a pipe, or vice versa, to open the clamps in order to release a pipe. A manipulator rod 8 is linked to the arms 6 in such a way that they enable synchronized operation. The manipulator rod 8 provides the final guidance of drill pipe 10 towards and into the drilling device 22. A brace unit 5 is rotatably attached to the strongback 4 about a second axis 2. The brace unit 5 is attached at one end to be rotatable about a third axis 3. Rotational movements preferably occur via journals and bearings. A slot or a coulisse guide 13 in a mounting bracket 32 restricts the movement of axis 3. In the lower portion of brace unit 5 a spring 29 is provided, primarily to hold axis 3 in its lower position in slot 13. Brace unit 5 may consist of two inclined legs, as will appear from FIGS. 8 and 9.

Figure 2:
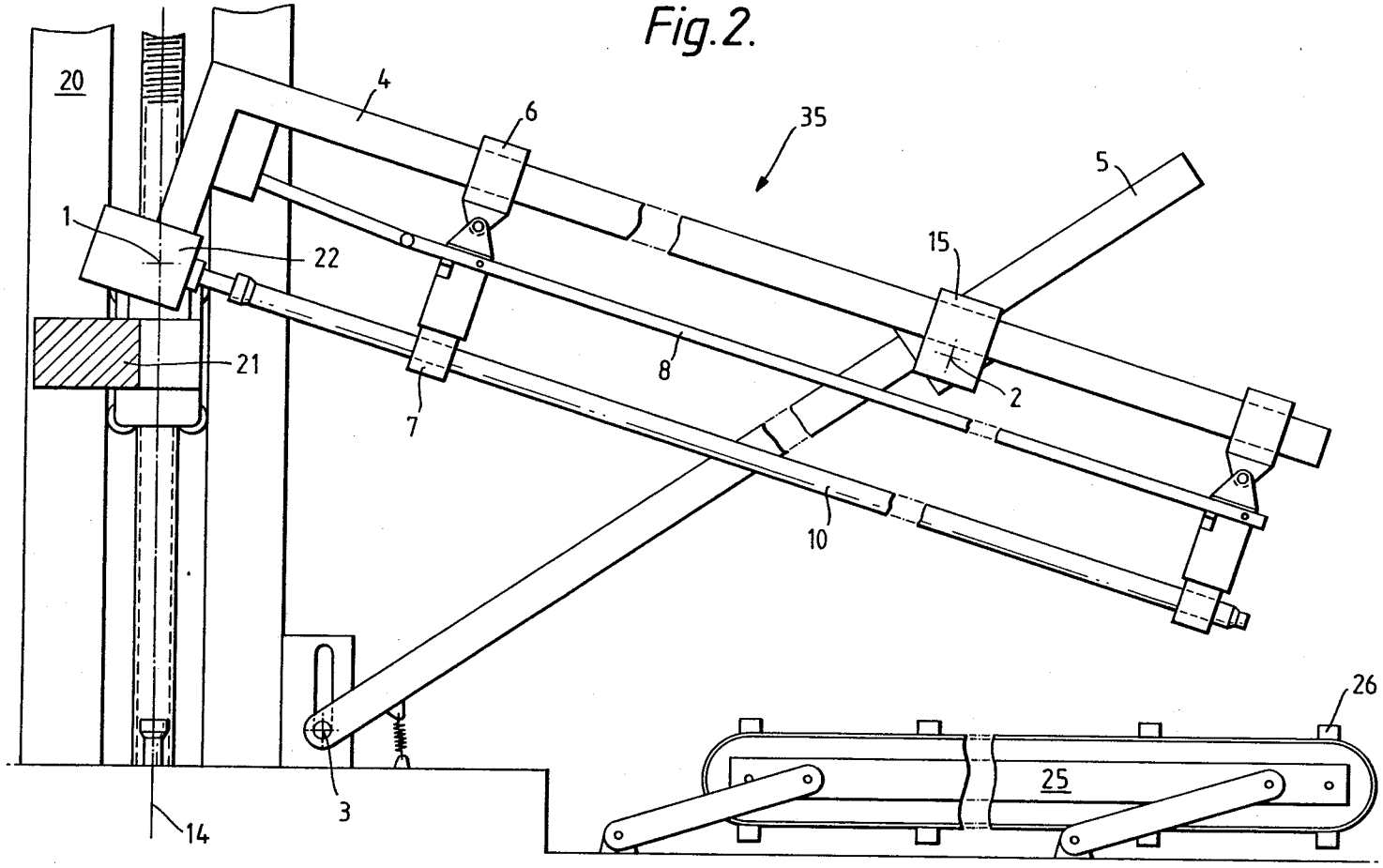
FIG. 2 is a diagrammatic view of the apparatus according to FIG. 1, in a partially raised position.

FIG. 2 illustrates the apparatus 35 in a raised position. The raising/lowering table 25 is returned to drill floor 40.

Figure 3:
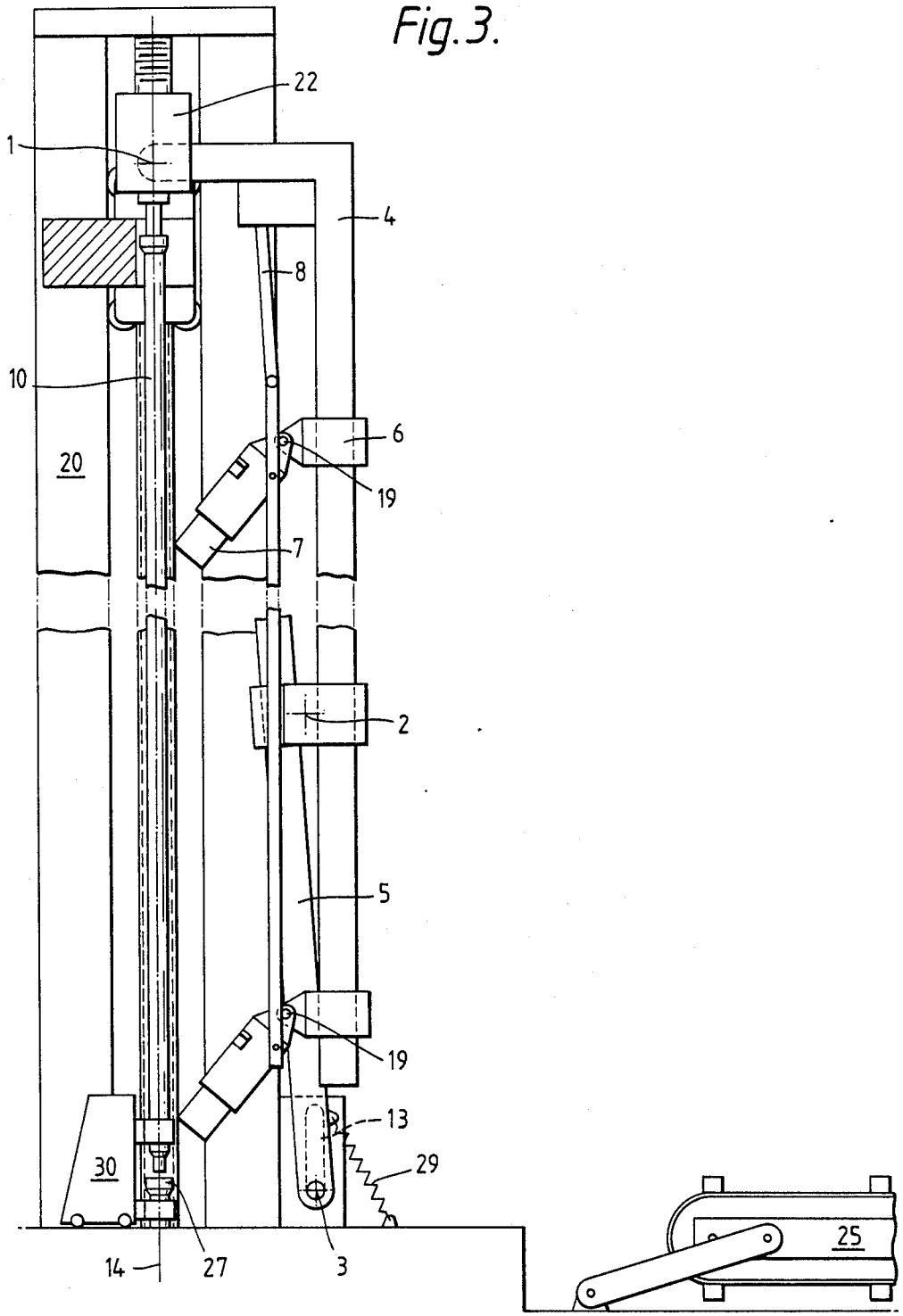
FIG. 3 is a view of the apparatus according to FIG. 1 in an approximately vertical position with the drilling device in its upper position.

FIG. 3 illustrates the apparatus 35 in its fully raised position with strongback 4 in a substantially vertical position. The slot 13 provides safety during raising operations of the drilling device 22 and apparatus 35. If the drilling device 22 is moved slightly too high the axis 3 will be pulled upwardly along the slot 13 at the same time as spring 29 attempts to pull the brace unit 5 down.

Figure 5:
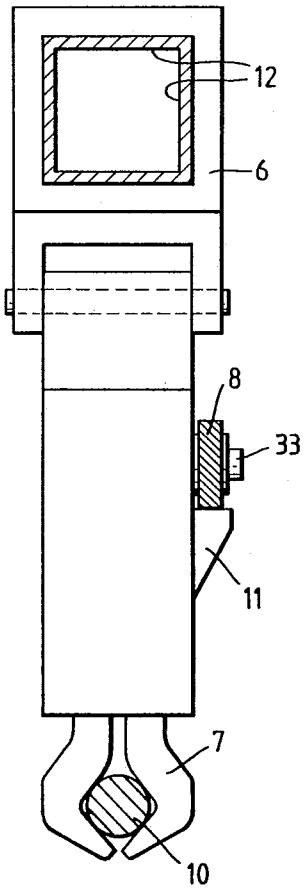
FIG. 5 is a diagrammatic view of the means according to FIG. 4 as seen from the derrick.
Figure 4:
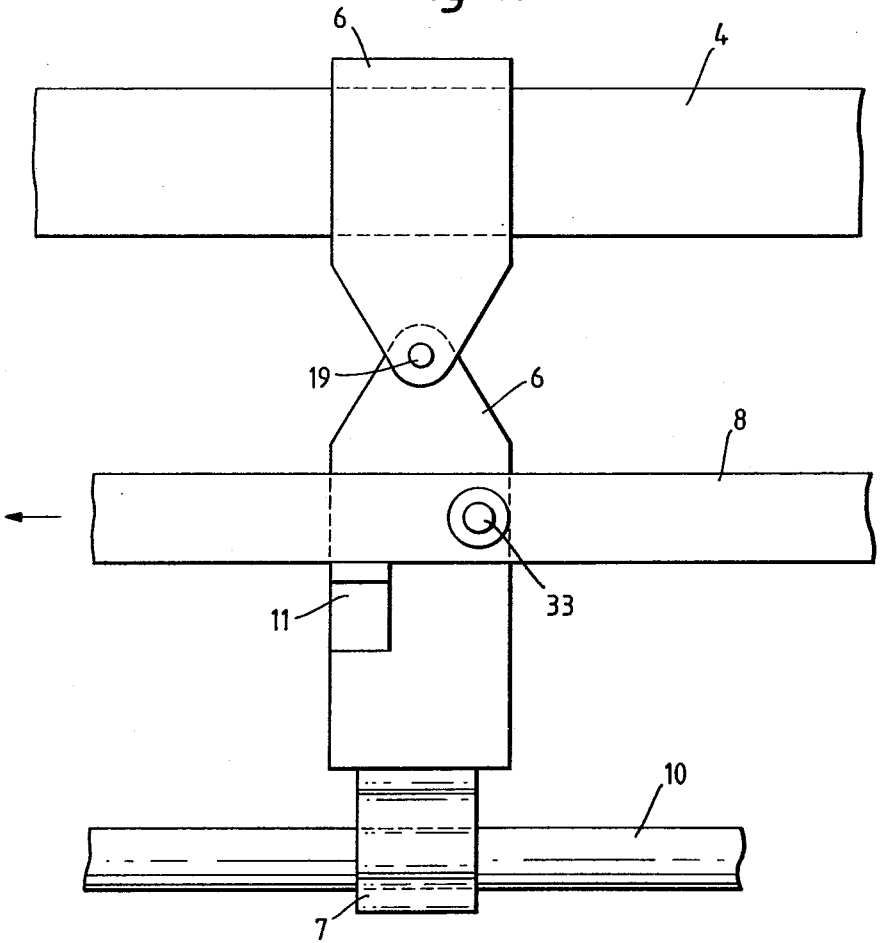
FIG. 4 is a diagrammatic view of the means holding and manipulating pipes in more detail.

FIG. 4 illustrates an arm 6 with clamps 7 in more detail. FIG. 5 illustrates the same arrangement as FIG. 4, as seen from the derrick 20. The arm 6 is articulated by means of the link or pivot 19. The arm 6 is slidable on the strongback 4 by means of sliding and guiding faces 12. Manipulator rod 8 is linked to the arms 6 by means of a pin 33. A lug or pawl 11 is provided on the arms 6. The articulated arm 6 and lug 11 cooperating with the manipulator rod 8 permits the arm 6 to turn about the pivot 19 away from the derrick, and conversely towards the derrick until a position of said arm is orthogonal to the strongback 4. By further movement of the arm 6 towards the derrick the lug 11 will cooperate with manipulator rod 8 to prevent further rotation. When the arm 6 is in an orthogonal position relative to the strongback 4, a further pull in the manipulator rod 8 will cause sliding displacement of the arm 6 along the strongback 4 and, thus, linear advancement of a drill pipe.

Figure 6:
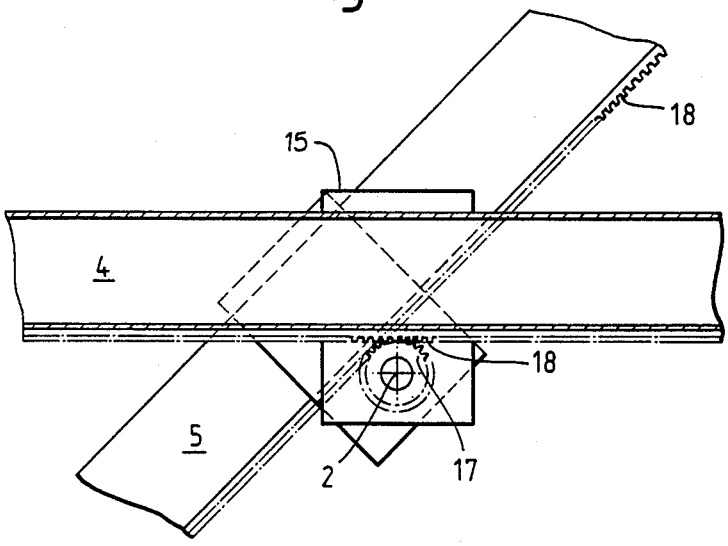
FIG. 6 is a diagrammatic view of the adjustable connection between the strongback and the brace unit.

FIG. 6 illustrates the rotatable connection 15 between the strongback 4 and the brace unit 5. These members turn relative to each other about the second axis 2. The strongback 4 and brace unit 5 are provided with means, e.g. in the form of racks 18, which may be displaced relative to each other. One or a plurality of motors may drive pinions 17 so as to adjust the strongback 4 and brace unit 5 to adapt the apparatus to pipe sections of different lengths.

Figure 7:
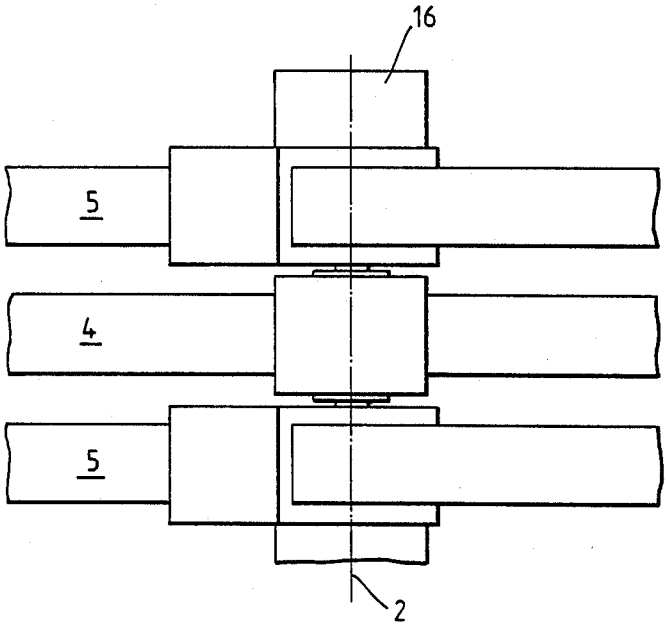
FIG. 7 is a plan view of the connection in FIG. 6.

FIG. 7 illustrates the connection 15 of FIG. 6 in a plan view. A motor 16 is indicated for mutual displacement between the brace unit 5 and the strongback 4.

For a more detailed description of the pipe handling operation, reference is given to FIGS. 1–3. A drill pipe 10 or a drill pipe stand consisting of two or three single pipes is moved from the drill pipe storage or drill floor 40 to a raised level by means of the raising/lowering table 25. When the drilling device 22 is in or approaches its lower position it is able to be turned about axis 1 to a lying or substantially horizontal position. The pipe 10 is roughly positioned relative to the drilling device 22 by means of the endless belt 31 providing only a slight distance between the drive shaft 34 of the drilling device 22 and the drill pipe 10. The clamps 7 embrace the pipe 10 and keep it fixed. The table 25 may then again be lowered towards the drill floor 40. The arms 6 are depending substantially vertically or orthogonally relative to the strongback 4 and, thus, the lug 11 cooperates with the manipulator rod 8. When the rod 8 is pulled towards the drilling device 22 the drill pipe 10 is pulled towards the drive shaft 34 in the horizontal direction by means of sliding means 12 along the strongback 14. The mutual spaces and structural design will cause the central axis of the pipe 10 to coincide with the central axis of drive shaft 34 when the drill pipe is suspended in the clamps 7. When the pipe 10 is advanced close to the shaft 34 said shaft is spun into the threaded end portion of the drill pipe 10. In order to adapt a vertical position of the drill pipe 10 the drilling device 22 is elevated in the derrick 20 and pulls the strongback 4, thus raising the entire pipe handling apparatus 35. Successively the drill pipe 10 adapts a more vertical position. The drilling device 22 gradually turns about the first axis 1 while rising in the derrick 20. The brace unit 5 turns about the third axis 3. Due to said structural conditions the drill pipe is transferred directly to the drill centre 14 when the strongback 4 has occupied a substantially vertical position. When the clamps 7 and the manipulator rod 8 are released, the outer portion of each articulated arm 6 falls due to its own weight. The arms 6 knuckle about the pivots 19. A roughneck 30 encircles the lower portion of the pipe, whereupon the drilling device and the pipe are lowered towards and into the upper threaded portion of the drill string 27. The pipe is spun into the threaded connection and makes up a predetermined momentum from the roughneck 30. The latter is subsequently removed and drilling may procede. The pipe handling apparatus is designed to prevent axes 1,2 and 3 from being aligned when the drilling device 22 is in its upper position, but axis 2 is slightly offset from an imagined connecting line between axis 1 and 3. Thus, a knee is formed between the strongback 4 and brace unit 5 when the drilling device 22 is again lowered. During the rising and lowering operation a new drill pipe is placed on the raising/lowering table 25 and is transferred from the drill floor to the horizontal initial position of the pipe handling apparatus. When a drill string is retrieved the apparatus works in the opposite sequence. It should further be appreciated that the apparatus naturally can be used for round trip operations as well.

Having described my invention, I claim:

1. A pipe-handling apparatus adapted for automatic drilling operations in which a plurality of drill pipes is manipulated in succession between a substantially horizontal initial or final position, and an approximately vertical drill center position, respectively, as a drill string is made-up and broken-down, said pipe handling device comprising:

an upright, fixed derrick;

a top-mounted drilling device;

means mounting said drilling device to said derrick for moving up and down, and for rotating said drilling device through a right angle about a first, horizontal axis between a first orientation in which said drilling device projects vertically downwards, for turning a drill pipe, stand or drilling string, and a second orientation in which said drilling device projects horizontally away from the derrick for connecting with or disconnecting from a drill pipe or stand;

a pipe-supporting strongback comprising means for releasably holding a drill pipe or a stand of drill pipes, said strongback having one end rotatably connected with said drilling device for pivotal movement about said first axis as said drilling device moves up and down relative to said derrick;

a brace unit having a lower end and an upper end;

means pivotally mounting said brace unit to said strongback above said lower end of said brace unit, for angular movement about a second, horizontal axis which is parallel to but transversally displaced from said first axis;

means pivotally supporting said lower end of said brace unit, for angular movement about a third, horizontal axis which is parallel to but transversally displaced from said first and second axes, whereby as said drilling device is raised and lowered, said strongback is angularly moved about said first and second axes and said brace unit is angularly moved about said second and third axes and consequently a drill pipe or stand, when held by said releasable holding means, is moved between said initial and final substantially horizontal positions, and said approximately vertical drill center position;

said releasable holding means comprising at least two arms mounted to said strongback at respective sites spaced longitudinally therealong, each arm having an openable, closable clamp mounted thereto for releasably holding a drill pipe or stand at respective sites spaced longitudinally along the drill pipe or stand, and means for operating said clamps to open and close them about said drill pipe or stand.

2. The pipe-handling apparatus of claim 1, further including:

means for synchronously moving said arms longitudinally of said strongback for inserting an end of a drill pipe into and retracting an end of a drill pipe from engagement with said drill device when a drill pipe or stand is releasably held by said clamps.

3. The pipe-handling apparatus of claim 2, wherein:

each said arm is articulated by a respective pivot joint to said strongback for angular movement about a respective horizontal axis; and each said arm further includes stop means for preventing rotation of said arms toward said drilling device about said pivot joints when said clamps are holding a drill pipe or stand, beyond approximately orthogonal positions of said arms relative to said strongback as said arms are moved longitudinally of said strongback.

4. The pipe-handling apparatus of claim 1, wherein:

said means pivotally mounting said brace unit to said strongback is arranged for displacement longitudinally along said strongback and said brace unit for adjusting spacing between said second axis and said third axis; and motor means operatively connected with said means pivotally mounting said brace unit to said strongback, for adjustably displacing said means pivotally mounting said brace unit to said strongback longitudinally along said strongback and said brace unit.

5. The pipe-handling apparatus of claim 1, wherein:

said means pivotally supporting said lower end of said brace unit, for angular movement about a third, horizontal axis is arranged to permit limited substantially vertical translation of said third axis.

6. The pipe-handling apparatus of claim 1, wherein:

when said drilling device is in said second orientation and lowered for connecting with or disconnecting from an end of a drill pipe or stand held by said clamps, said third axis and said drill center position are spaced apart horizontally by a distance which is less than the distance orthogonally between such drill pipe or stand and the longitudinal axis of said strongback.

* * * * *